United States Patent [19]

Thompson

[11] 4,094,422

[45] June 13, 1978

[54] BUCKET LOADER BOOM

[75] Inventor: Arthur David Thompson, Chorley, England

[73] Assignee: Dobson Park Industries Limited, Nottingham, England

[21] Appl. No.: 724,639

[22] Filed: Sep. 20, 1976

[30] Foreign Application Priority Data

Oct. 7, 1975 United Kingdom ..... 41111/75

[51] Int. Cl.[2] ..... E02F 3/81

[52] U.S. Cl. ..... 214/145 R; 212/144; 214/138 R

[58] Field of Search ..... 214/138 R, 145 R, 145 A; 212/144

[56] References Cited

U.S. PATENT DOCUMENTS

| | | | |
|---|---|---|---|
| 2,754,985 | 7/1956 | Przybylski | 214/138 R |
| 2,801,012 | 7/1957 | Lederer | 214/138 R |
| 3,195,747 | 7/1965 | Kashergen | 214/138 R |
| 3,495,728 | 2/1970 | Long | 214/138 R |
| 3,578,188 | 5/1971 | Drieschner | 214/138 R |
| 3,989,149 | 11/1976 | Smith et al. | 214/138 R |
| 3,991,886 | 11/1976 | Thorsell | 214/138 R |

FOREIGN PATENT DOCUMENTS

| | | | |
|---|---|---|---|
| 740,293 | 8/1966 | Canada | 212/144 |
| 1,162,052 | 1/1964 | Germany | 212/144 |

*Primary Examiner*—Drayton E. Hoffman
*Assistant Examiner*—Ross Weaver
*Attorney, Agent, or Firm*—Brady, O'Boyle & Gates

[57] ABSTRACT

A boom arrangement for a bucket loader of particular use in the context of low headroom mine workings comprises two articularly connected boom elements having ram means for varying the relative angular positions thereof and a further ram means for raising or lowering the articularly connected elements, that ram means intended for varying the relative angular positions of the articularly connected boom elements being disposed within the acute angle formed by and between such elements.

7 Claims, 4 Drawing Figures

BUCKET LOADER BOOM

The invention concerns a bucket loader boom.

The primary object of the invention is to provide a simple, yet effective, boom arrangement for, for example, the bucket of a bucket loader of the kind embodied in the machine disclosed in our copending U.S. patent application Ser. No. 734,637, entitled "Mining and Like Machinery", filed Oct. 15, 1976.

According to the present invention there is proposed a boom arrangement which comprises two articularly connected boom elements for pivotal mounting on a support and adapted to carry a bucket, or other load conveying and/or discharging means, at the remote end thereof, first ram means extending between and connecting the boom elements, for adjusting the relative angular positions of such elements, and second ram means extending between and connecting the boom elements to the support and being adapted for pivotally raising and lowering the boom arrangement, characterised in that the first ram means is disposed within the acute angle formed by the articularly connected boom elements.

Preferably, though not necessarily, the first and second ram means are provided on opposite sides of that boom element intended for pivotal mounting on the support.

According to a further preferred feature, the support comprises a yoke pivotally mountable upon a support structure for motion about an axis perpendicular to the pivot axis of the articularly connected boom elements.

According to a further feature, the boom elements include parts extending laterally therefrom adapted to receive an end of a ram means into pivotal connection therewith.

The invention will now be described further, by way of example only, with reference to the accompanying drawings illustrating two embodiments thereof and in which.

Figure 1:
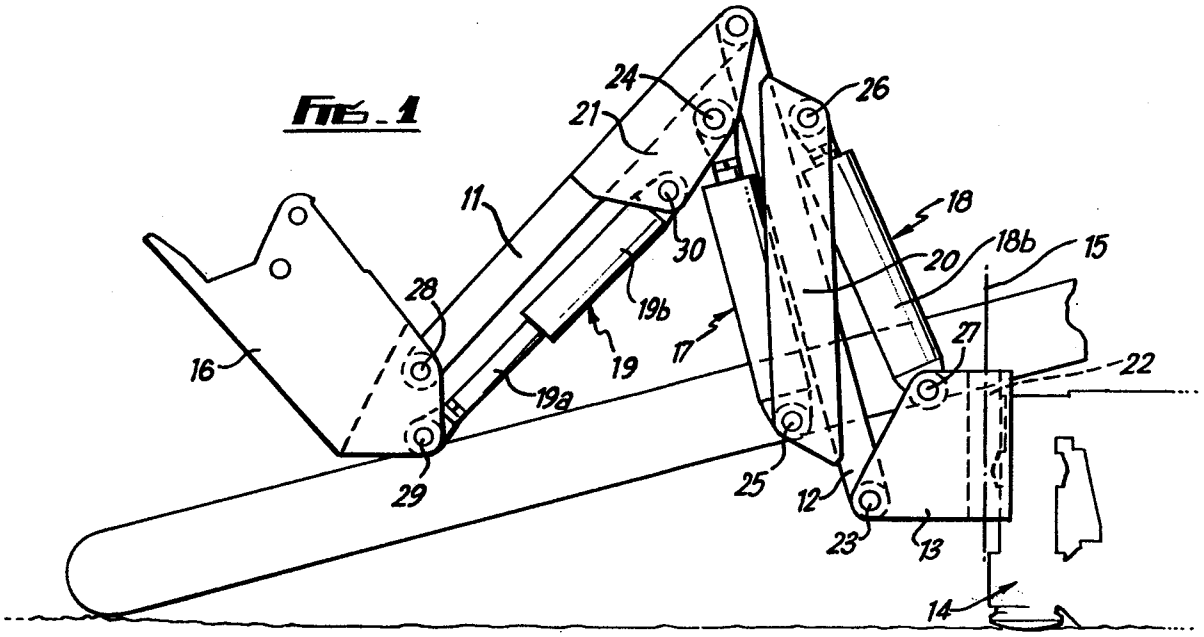
FIG. 1 is a diagrammatic side elevation of a boom and bucket arrangement constructed in accordance with the invention, the boom being in a raised, and retracted condition.
Figure 2:
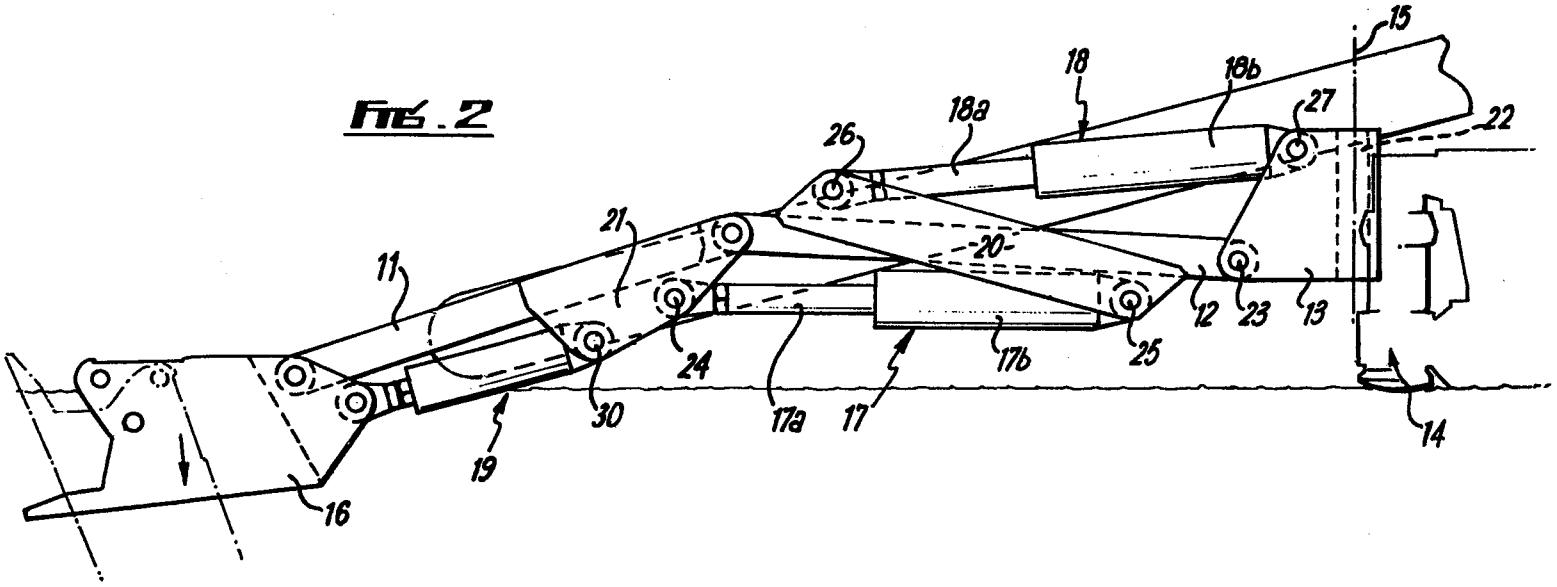
FIG. 2 is a corresponding view to that of FIG. 1, showing the boom in a lowered, and extended, condition.

Referring now to FIGS. 1 and 2 of the drawings, which show the boom and bucket arrangement supported on the forward end of a support machine or vehicle, a boom arrangement constructed in accordance with the present invention comprises two articularly connected boom elements 11,12 pivotally mounted, at one end, on a yoke 13 itself rotatably secured to the front of the machine 14 for limited pivotal motion about a generally vertical axis 15, the other end of the boom arrangement being adapted to support a bucket 16, ram means 17.18 for varying the relative angular positions of the boom elements 11,12 and for raising or lowering the boom arrangement, respectively, and further ram means 19 mounted on that boom element 11 which carries the bucket 16 for varying the angular position of the bucket relative to such element.

Boom element 12 carries a plate 20 at each side thereof and securely attached thereto, the plates being generally of parallelogram shape and being so disposed relative to element 12 as to extend laterally of such element at positions spaced from the respective ends of the boom.

Similarly, boom element 11 carries a generally triangular-shaped plate 21 at each side thereof at a position adjacent that end of the element 11 whereat elements 11,12 are articularly connected, plates 21 extending laterally of the boom element and towards the adjacent element 12.

The yoke 13 is mounted on a vertical spindle 22 coaxial with axis 15, and boom element 12 is pivotally supported thereon for motion about a generally horizontal axis by means of a pin 23.

The ram means 17 for controlling the relative angular positions of the boom elements 11,12 consists of an hydraulic piston and cylinder arrangement of which the piston rod **17*a* is pivotally secured to and between the spaced plates 21 by a pin 24 at a position adjacent the pivot connection between the boom elements, whilst the cylinder 17*b* is likewise secured to and between the plates 20 carried by boom element 12 by a pin 25** at a position whereat such plates extend laterally from the boom element and at the underside of such element.

Similarly, ram means 18 for raising and lowering the boom arrangement comprises a piston and cylinder arrangement of which the piston rod **18*a* is connected to and between plates 20 whereat such plates extend laterally from and above the boom element adjacent the upper end of such element by means of a pin 26 engaged with suitable apertures in the plates, the cylinder 18*b* being secured to the yoke 13 by means of a pin 27, pins 23 and 27** being arranged in parallel spaced apart disposition.

The bucket 16 is pivotally mounted on boom element 11 by means of a pin 28, and the further ram means 19 provided for controlling the angular position of such bucket relative to the axis of pin 28 comprises a piston and cylinder arrangement of which the piston rod **19*a* is secured to the bucket, as at 29, and the cylinder is secured to and between the plates 21 by a pin 30, pins 24 and 30 being spaced apart in the longitudinal direction of the boom element 11**.

Yawing motion of the total boom/bucket structure about the axis of spindle 22 is effected by means not shown, whilst raising and lowering of the bucket and extension and retraction thereof relative to the yoke is effected by a combination of the operations of the ram means 17,18. The angular position of the bucket relative to its pivotal axis is determined by the condition of the further ram means 19.

By means of the structure as hereindescribed we are able to provide a boom arrangement for a bucket loader which is of simple and compact construction as compared with prior art structures wherein the various rams are provided within the obtuse external angle of the articulation point of the boom elements. Furthermore, the avoidance of a longitudinally directed extension to the forward boom element to give a cantilever structure through which motion is imparted to vary the angle between the boom elements in the region of the pivot connection between such elements will reduce the vertical dimensions of the structure and will, in addition, remove a source of weakness in the prior structure which arises from the exposed nature of the connection and the likelihood of damage to such connection.

The disposition of the ram means for varying the relative angular positions of the boom elements does offer an advantage over the prior structures in as much as there is a greater design freedom as regards the positioning of the point of connection of the ram to the forward element, thereby allowing of the utilising of a greater mechanical advantage for the ram than is possible, within practical limitations, for cantilever arrangements.

Figure 3:
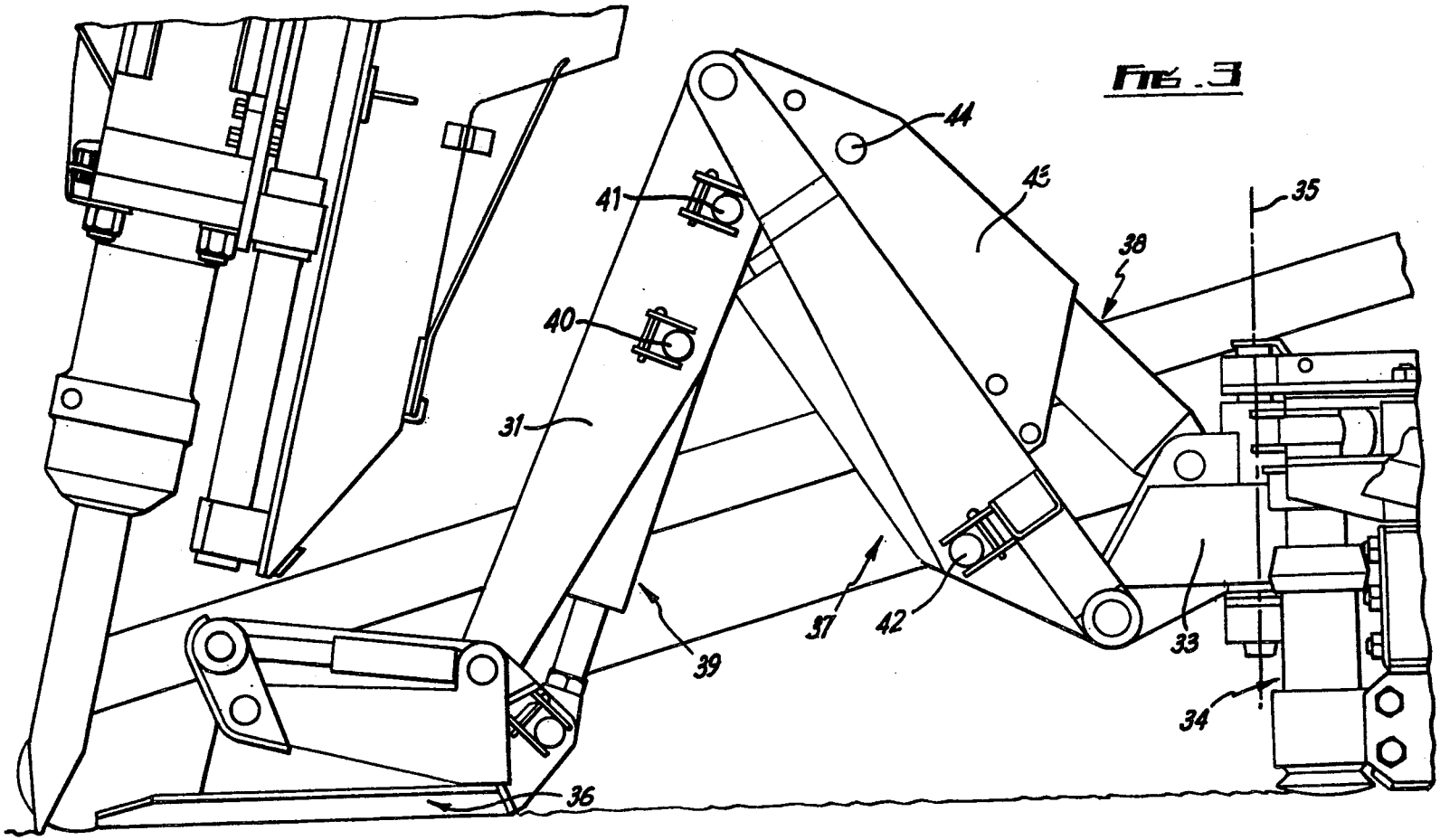
FIG. 3 is a side elevation of a boom and bucket arrangement as applied to an impact rock breaker machine as disclosed in our copending patent application Ser. No. 734,637.
Figure 4:
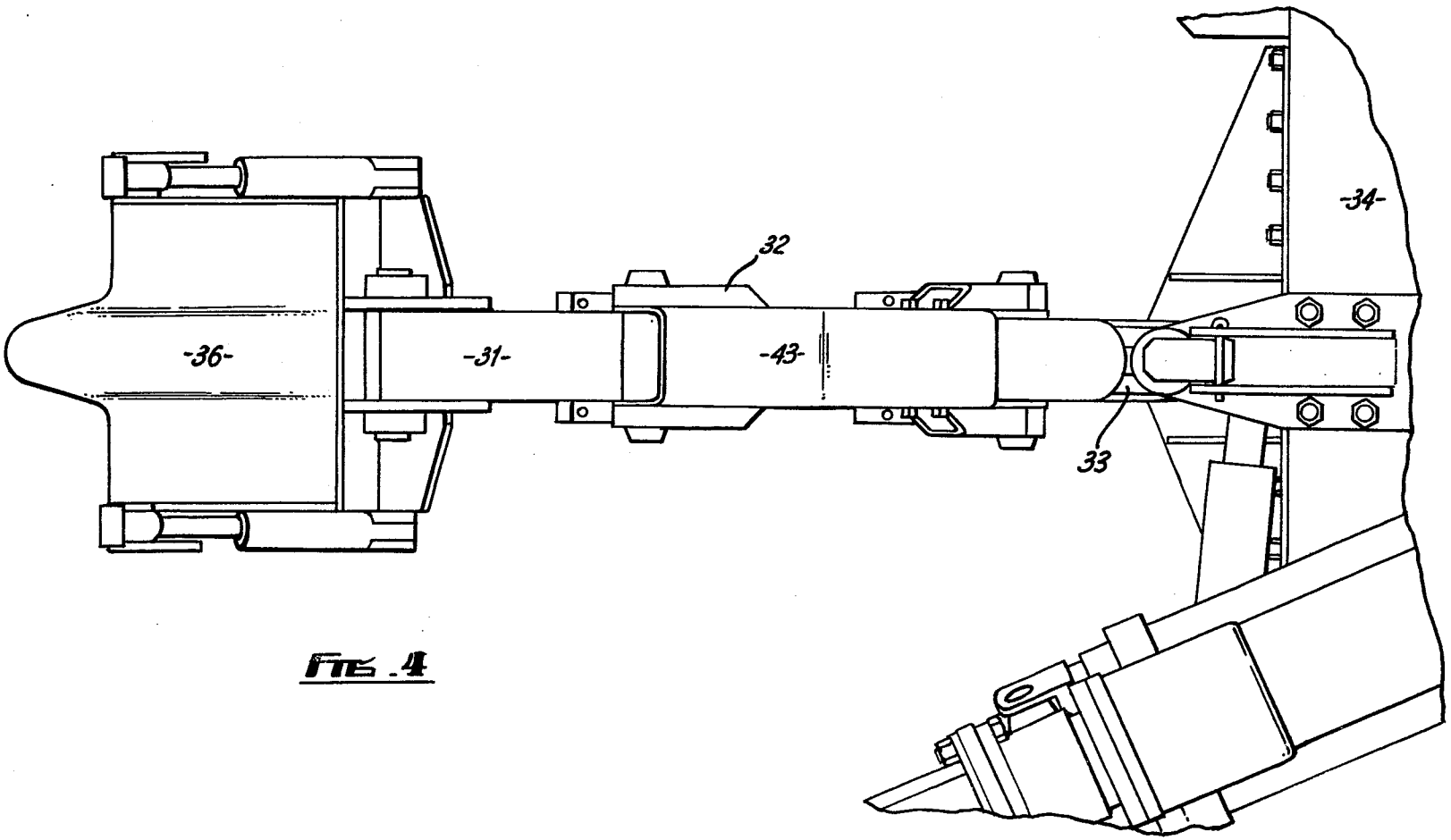
FIG. 4 is a plan view of the arrangement shown in FIG. 3.

FIGS. 3 and 4 show a boom and bucket arrangement of the kind here envisaged as applied to the impact rock breaker machine as disclosed in our copending U.S. patent application Ser. No. 734,637.

Thus, referring now to FIGS. 3 and 4, the boom arrangement comprises articularly connected forward and rearward boom elements 31,32 mounted at one end, on a yoke 33 secured to the forward end of a support vehicle 34, the yoke being capable of limited pivotal motion about a generally vertical axis 35, and carrying, at the other end, a bucket 36, there being ram actuator means 37,38 for varying the relative angular positions of the boom elements 31,32 and for raising and lowering the boom arrangement, respectively, and further ram actuator means 39 mounted on boom element 31 for varying the angular position of the bucket relative to such boom element.

Boom elements 31,32 differ from the corresponding elements of the structure shown in FIGS. 1 and 2 as regards the attachment of the relevant parts of the ram actuator means 37, 38 and 39, the plates 20, 21 of the structure of FIGS. 1 and 2 being omitted, and alternative structures being provided to form attachment points for the various ram means.

The boom elements 31, 32 are both of channel section having a web portion forming a top wall and a pair of flange portions depending from the web portion forming a pair of downward inclined side walls thereby providing respective protected inner spaces therein, the ram actuator means 39, 37 being located partially within a respective inner spaces of such elements, the side walls of the elements being of increased height to provide journals to receive pins 40,41,42 for attachment of the ram actuator means 39,37 to the respective elements. A further channel section, a piggy-back member 43 also having a web portion forming a top wall and a pair of flange portions depending therefrom is secured in inwardly facing disposition to the back of boom element 32 providing yet another protective interior space therein, the flange portions of the channel section 43 being of reducing height towards the unsupported end of the element. The forward part of ram actuator means 38 is disposed within channel member 43 and the piston rod of such means is pivotally attached to the further channel member by means of a pin 44 extending transversely thereof.

The boom arrangement as aforesaid is of particular application in the context of mining machinery for use in enlarging tunnels and forming headings in low headroom mine workings.

The invention is not restricted to the exact features of the embodiment described since alternatives will readily present themselves to one skilled in the art.

Thus, whilst the preference is for hydraulic rams as a means for effecting the various movements, pneumatic rams may be preferred in some cases.

Budkets other than that shown may be utilised, if preferred, as indeed may other load conveying and/or discharging means of a character appropriate to the intended context.

In another arrangement, not illustrated, the first and second ram means are provided at the same side of that boom element intended to be pivotally mounted on the support, each such ram means being adapted to effect pivotal motion of a respective one of the boom elements about its respective pivot axes.

What we claim is:

1. A protective type of boom structure for the actuator means in a bucket loader which is particularly adapted for low headroom mine workings comprising:

a yoke having at least limited pivotal motion about a generally vertical axis, two articularly connected boom elements pivotally coupled to said yoke, one a remote or forward boom element and one a yoke or rearward boom element, each comprised of channel sections having a web portion forming a top wall and a pair of flange portions depending from said web portion forming a pair of downward inclined side walls thereby providing respective protected interior spaces therein, a piggy-back channel section mounted forwardly on the top of said rearward boom element, also having a web portion forming a top wall and a pair of flange portions depending therefrom forming a pair of downward inclined side walls meeting the web portion of the boom element providing yet another protective interior space therein, first ram actuation means extending along and at least partially within the interior space of said rearward boom element and between the rear end portions of said forward and rearward boom elements and being connected thereto so as to be operable to adjust the relative angular position of said boom elements, second ram actuator means coupled at one end to said yoke and extending into said yet another protective interior of said piggy-back channel section and coupled at its other end to the forward portion thereof and being operable thereby to raise and lower the boom structure, and third ram actuator means extending along and at least partially within the interior space of said forward boom element being coupled at one end to the bucket loader and its other end to a selected portion of said forward boom element and being operable to adjust the angular position of the bucket loader relative to said rearward boom element, said channel sections thereby not only protecting the respective ram actuator means against mechanical damage but said web portions thereof being additionally able to protect the ram actuator means from overhead spoil in said mine working which may foul the ram actuator means and thus render them inoperable.

2. The boom structure as defined by claim 1 wherein said flange portions of said channel sections of said rearward boom element and said piggy-back channel section are in substantial mutual vertical alignment.

3. The boom structure as defined by claim 1 wherein the height of the flange portions of the piggy-back section decreases from back to front to provide a forward sloping web portion of the piggy-back channel section.

4. The boom structure as defined by claim 3 wherein the flange portions of the piggy-back sections are generally four sided and include a top and bottom edge and a front and rear side edge, said bottom edge meeting the web portion of the rearward boom element, said side edges being inclined toward one another, and said web portion thereof extending along the top edge and the front side edge whereby a double slope of said web portion of the piggy-back section is provided.

5. The boom structure as defined by claim 4 wherein the yoke is pivotally mounted on the forward end of the mine working vehicle.

6. The boom structure as defined by claim 1 and additionally including a support structure upon which the yoke is mounted.

7. The boom structure as defined by claim 6 wherein said support structure comprises a mine working vehicle.

* * * * *